US006349770B1

(12) United States Patent
Brooks et al.

(10) Patent No.: US 6,349,770 B1
(45) Date of Patent: Feb. 26, 2002

(54) TELESCOPING TOOL

(75) Inventors: Robert T. Brooks; John Whitsitt, both of Houston, TX (US)

(73) Assignee: Weatherford/Lamb, Inc., Wilmington, DE (US)

( * ) Notice: Subject to any disclaimer, the term of this patent is extended or adjusted under 35 U.S.C. 154(b) by 0 days.

(21) Appl. No.: 09/483,342

(22) Filed: Jan. 14, 2000

(51) Int. Cl.[7] ..... E21B 23/08

(52) U.S. Cl. ..... 166/383; 166/375; 166/323; 166/242.7

(58) Field of Search ..... 166/375, 374, 166/382, 383, 323, 242.7

(56) References Cited

U.S. PATENT DOCUMENTS

| | | | | |
|---|---|---|---|---|
| 4,305,465 A | * | 12/1981 | Ellis | 166/382 |
| 4,542,792 A | * | 9/1985 | Akkerman | 166/374 |
| 4,566,478 A | * | 1/1986 | Deaton | 137/112 |
| 5,127,476 A | * | 7/1992 | Dickson et al. | 166/323 |
| 5,167,284 A | * | 12/1992 | Leismer | 166/374 |
| 5,285,850 A | | 2/1994 | Bayh, III | 166/321 |
| 5,954,133 A | | 9/1999 | Ross | 166/297 |
| 6,003,607 A | | 12/1999 | Hagen et al. | 166/381 |

FOREIGN PATENT DOCUMENTS

| | | | |
|---|---|---|---|
| EP | 0 331 227 A1 | 9/1989 | E21B/33/035 |
| EP | 0 589 586 A2 | 3/1994 | E21B/17/07 |
| EP | 0 982 469 A2 | 3/2000 | E21B/43/04 |
| GB | 0 235 938 A | 3/1991 | E21B/34/06 |
| GB | 2 321 076 A | 7/1998 | E21B/34/10 |
| WO | WO 00/01915 | 1/2000 | |

OTHER PUBLICATIONS

PCT Search Report issued in Int'l. Appl. No. PCT/GB01/00041, mailed Apr. 12, 2001.

* cited by examiner

*Primary Examiner*—William Neuder
*Assistant Examiner*—Zakiya Walker
(74) *Attorney, Agent, or Firm*—Moser, Patterson, & Sheridan, LLP.

(57) ABSTRACT

The present invention provides a space-out compensating apparatus and method for sequentially and simultaneously landing an anchor seal assembly into a previously run downhole packer, and landing a tubing hanger into a wellhead, so that the integrity of the seals in the anchor seal assembly of the tool is not compromised, and the completion can be concluded in a single run.

35 Claims, 10 Drawing Sheets

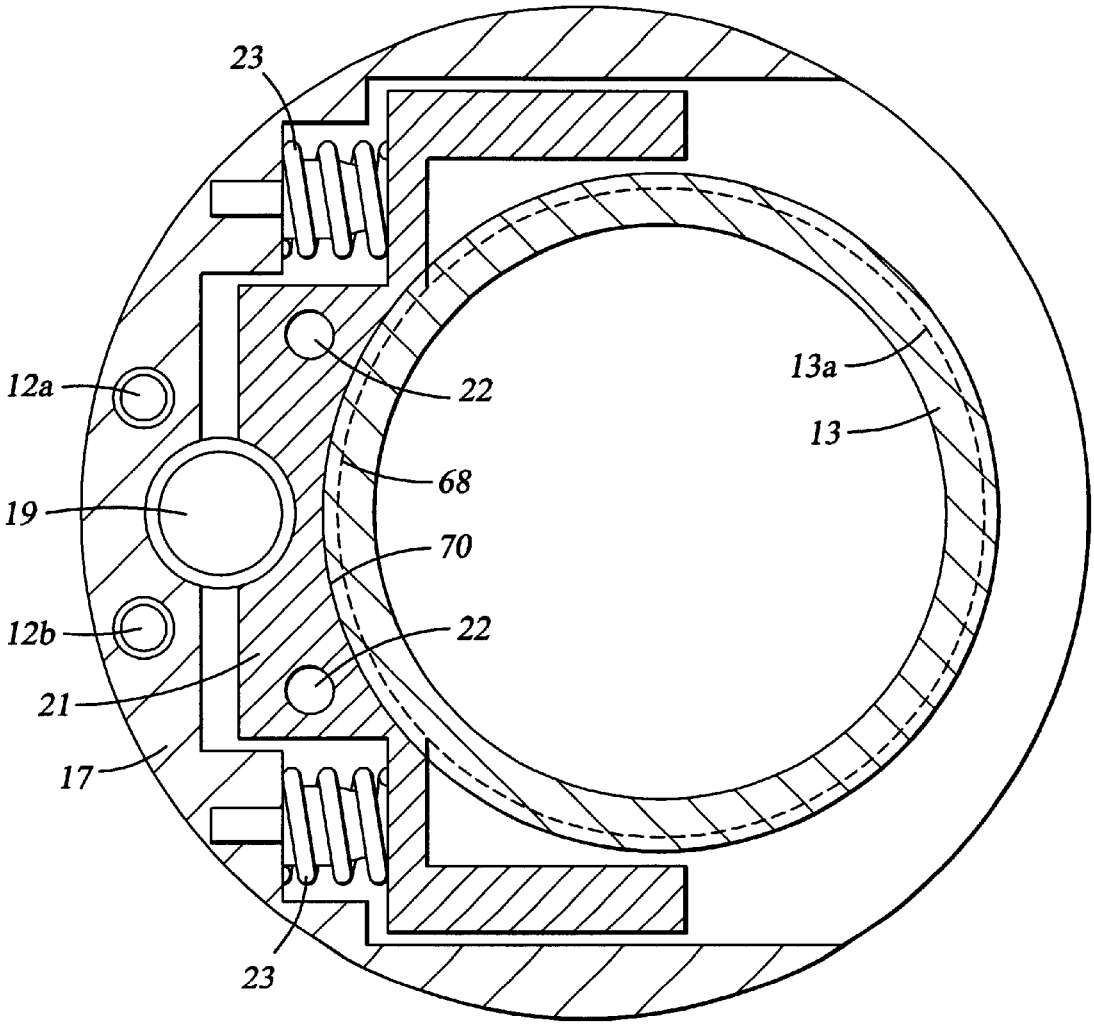
Fig. 3
Fig. 4
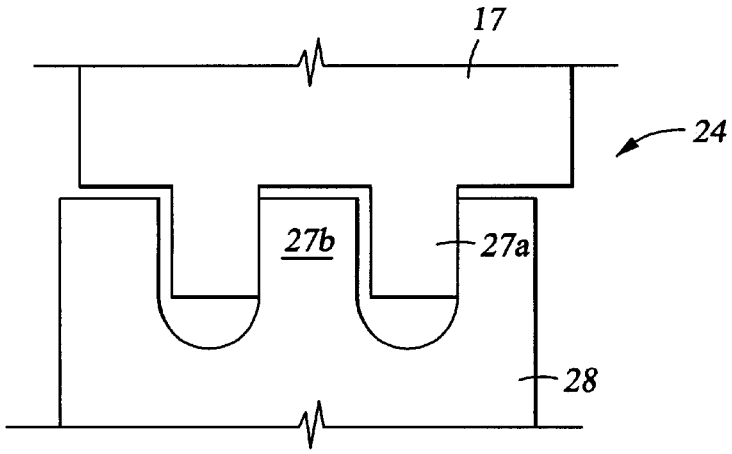

TELESCOPING TOOL

BACKGROUND OF THE INVENTION

1. Field of the Invention

The present invention relates to well completion methods and apparatus. More particularly, the invention relates to methods and apparatus for engaging a downhole latching and anchoring assembly in a well and sequentially or simultaneously landing a well head into position without the intermediate removal of the tubing string from the well.

2. Background of the Related Art

Subsea well completions and workover operations can be extremely expensive to perform because of the complexity, size and inaccessibility of the well bore. Typically, a well head or well control valve complex is anchored to casing located on the sea bottom. A floating drilling platform or drilling ship having a position holding propulsion system positions the derrick above the well borehole and maintains the derrick and draw works in one position while the completion or well workover is taking place. Such equipment is very costly both in terms of capital investment and in terms of shielded labor trained in its usage. Such units, depending upon size, location of the well, etc. can cost one million dollars per day or more to operate. It is, therefore, desirable to minimize the time on location of such units during the drilling or work over of a subsea well.

Typically during a workover or reinstallation of a well completion system in a remote subsea well, at least two tubing runs are required. For example, using the current methods of workover or re-completion, a first tubing run is made into the borehole to "land" or secure an anchor seal assembly into the Bottom Hole Assembly (BHA) which has been left in place during the workover. This first tubing run also serves to determine the exact position of the tubing hanger in relation to the BHA. Then, the well tubing is at least partially pulled out of the hole in order to allow a subsea well head tubing hanger to be positioned correctly in the tubing string and a second tubing run is then made to "land" the anchor seal assembly and the subsea tubing hanger. Risks are involved in disengaging the anchor seal unit from the downhole packer in the BHA as the seal unit could accidentally be damaged in the process. This could require the entire seal unit to be removed from the well for replacement, essentially starting the process over.

It is, therefore, apparent that methods and apparatus for eliminating such multiple tubing runs into the well and to accomplish both landing an anchor seal unit and a subsea wellhead tubing hanger in a single tubing run in the well would provide both cost saving and safety advantages to operations in the industry.

SUMMARY OF THE INVENTION

One embodiment of the invention generally provides a space-out compensating downhole well tool and a method for its use. The apparatus and method of the invention allow for sequential or simultaneous (in a single tubing run) landing an anchor seal assembly and landing a tubing hanger into a subsea well head or control valve complex.

In one aspect, the tool includes an outer body fixable in a well and an inner body selectively allowing the tubing string to move between a first and second position in the well in order to properly locate a tubing hanger in a fixture after the outer body has been fixed in the well.

In another aspect, a well tool is provided which includes a polished bore receptacle, a lockout block having coil springs which urge the lockout block into contact with a thread profile, such as a thread form or other ratchet mechanism, on the tubing above the tubing seal assembly and a lockout block housing having a dog clutch mechanism on the lower end of the tool. The well tool can be run in on the tubing string later used for production of hydrocarbon from the well.

In another aspect, the invention provides a tool having two or more lockout blocks in one or more lockout block housings to enable telescoping of the tool and to insure that at least one of the lockout blocks engages a tubular body member actuation. The tubular body member may be one or more pipe joints having thread forms formed on the external surface thereof. The lockout blocks preferably have mating thread forms to engage the thread forms on the tubular body member on actuation. A single lockout member or multiple lockout members can be used to lock the lockout blocks into engagement with the tubular body member.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

FIG. 3 is a cross-sectional view along line 3—3 of FIG. 1B showing the lockout block assembly.

FIG. 4 is a cross sectional view along lines 4—4 of FIG. 1B showing the dog clutch assembly.

DETAILED DESCRIPTION OF THE PREFERRED EMBODIMENT

Figure 1A:
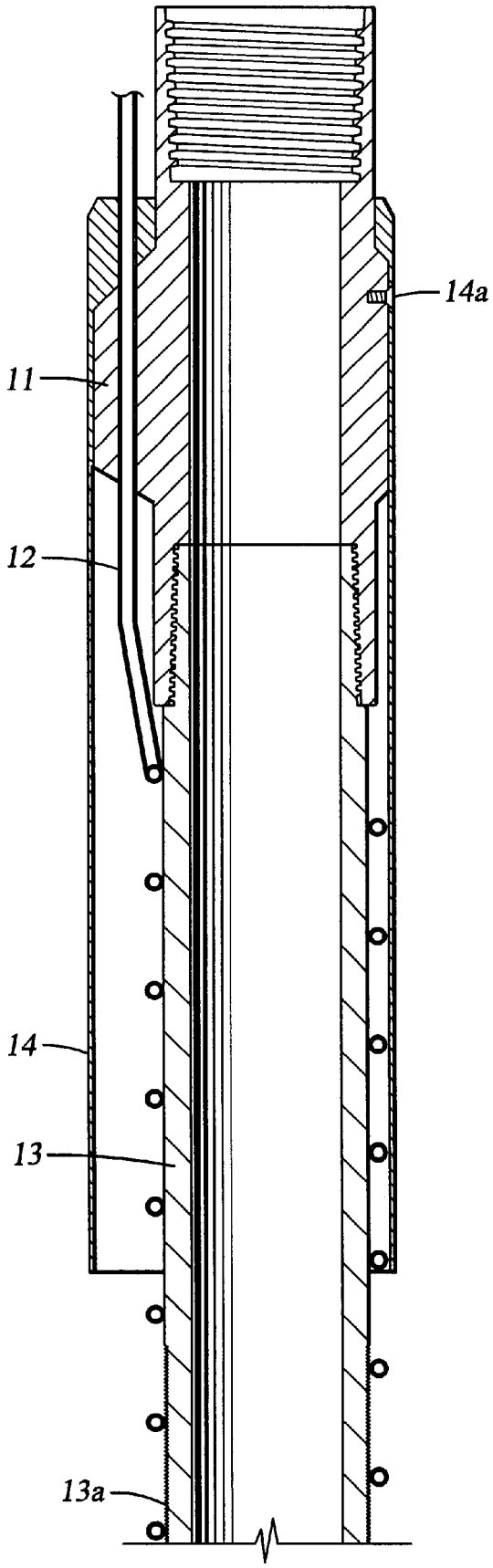
FIG. 1A is a cross sectional view of the upper end of a tool of the invention showing the control line manifold block, the protective shroud for the control lines and a portion of the interconnecting tubing.

FIG. 1A is a sectional view of the top or upper end of one embodiment of a tool of the invention. The tool is usable in subsea or any other type of well. The tool generally includes a tubular body member 13, such as one or more pipe joints, connected at its upper end to a manifold block 11 at threads 15. A hydraulic control line 12 runs from above to the manifold block 11 and below the manifold block 11 the control line 12 is wound helically about tubular body member 13. The number of helical turns and their spacing is controlled by the length of stroke of the space out apparatus of the invention.

The control line 12 may be protected for run-in by a protective shroud 14. Shroud 14 may be formed from tubing having a diameter larger than body member 13. The shroud 14 can be affixed to manifold block 11 by pins or screws 14*a*. The tubular body member 13 also includes thread forms or non-helical grooves 13*a* on at least a portion of its outer diameter.

Figure 1B:
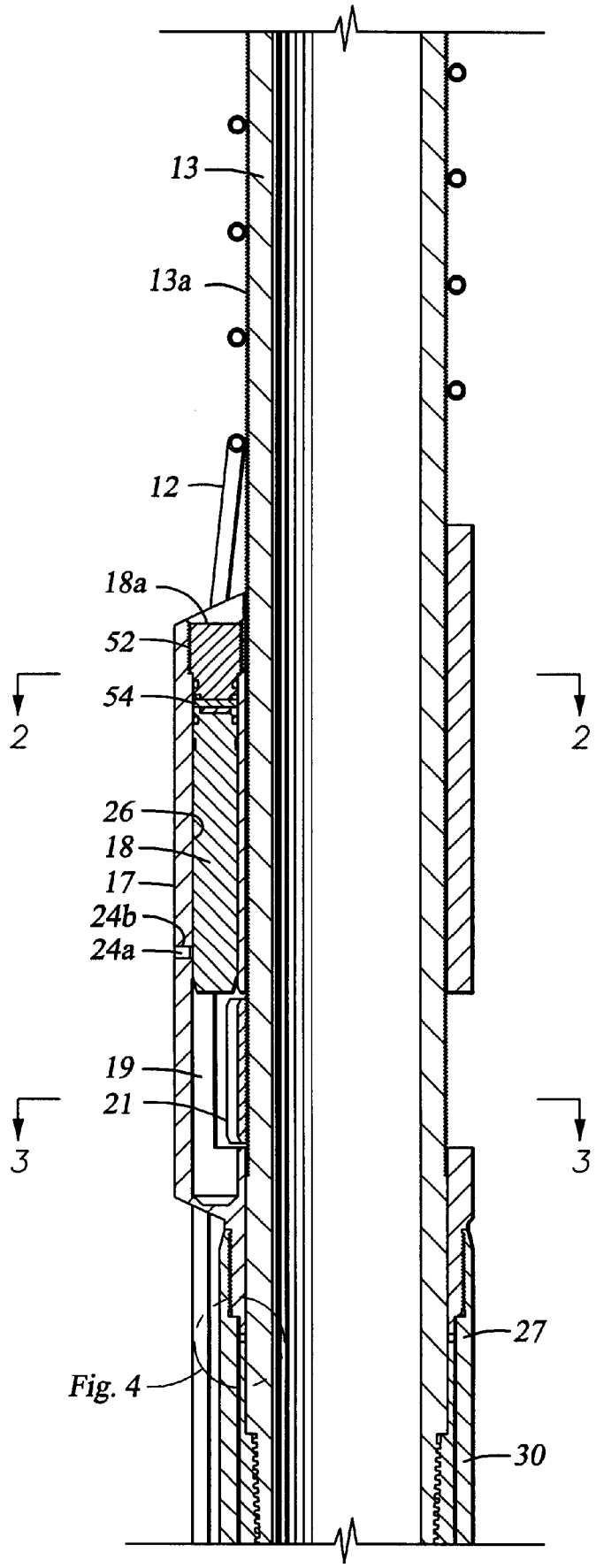
FIG. 1B is a cross sectional view of a tool of the invention showing the lockout block, lock piston, lockout block housing and control line to the lockout block.
Figure 2:
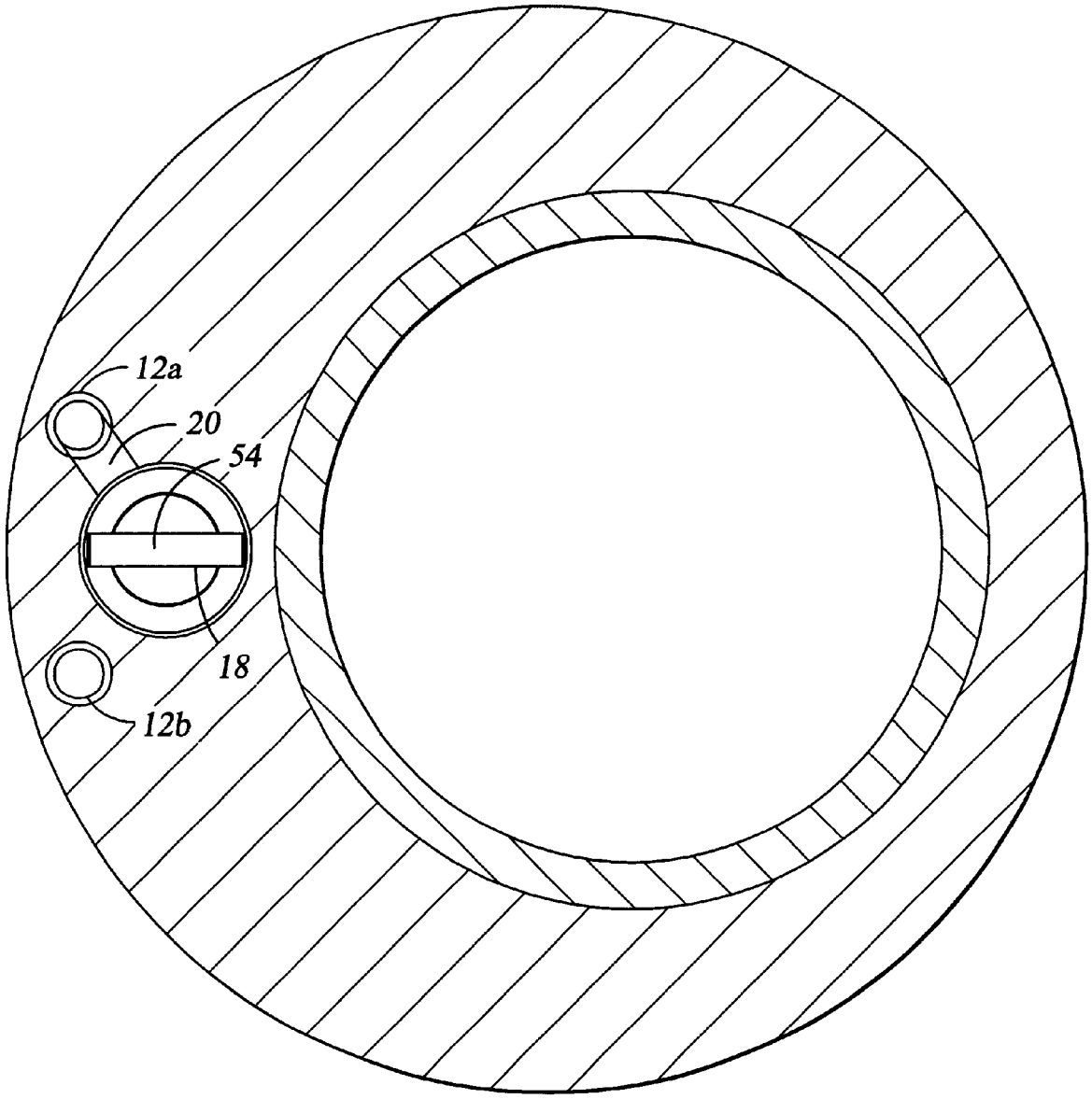
FIG. 2 is a cross-sectional view along line 2—2 of FIG. 1B showing the lock piston assembly.

FIG. 1B is a sectional view of a mid portion of one embodiment of the tool illustrating a lockout assembly. The outer portion of the tool includes a lockout block housing 17 connected on its lower end to a polished bore receptacle 30. Polished bore receptacle is constructed and arranged to allow axial movement of the tubing string therein when the telescoping tool is actuated. Control line 12 is connected to the upper end of lockout block housing 17. Lockout block housing 17 includes an internal channel 19 which houses a lock member 18, such as a lock piston, therein. A lock piston cap 18*a* is secured to the lockout block housing 17 by threads 52. Lock piston 18 is retained at a retracted position within channel 19 by shear pin 54. The lower end of lock piston 18 is slidably disposed above a lockout block 21. FIG. 2 is a section view taken along line 2—2 of FIG. 1B. Visible in FIG. 2 is port 20 providing fluid communication between control line 12A and lock piston 18. In the preferred embodiment, fluid pressure applied to the top surface of lock piston 18 supplies force adequate to break shear pin 54 and cause lock piston 18 to move downward away from lock piston cap 18A into channel 19. A lockout block 21 has thread forms formed on at least a portion of its internal surface to engage the thread forms 13*a* of the tubular body member 13 to prevent relative movement therebetween. The lockout block housing 17 is provided with a snap ring 24*a* in a groove 24*b* near its lower end which is initially retained in an open position between the housing 17 and the lock piston 18. When the lock piston 18 is later moved downward, by fluid pressure, electric motor or other type of actuation, away from lock piston cap 18*a*, a groove 26 in the outer surface of the lock piston allows the piston 18 to capture snap ring 24*a* and become locked in place.

Figure 1C:
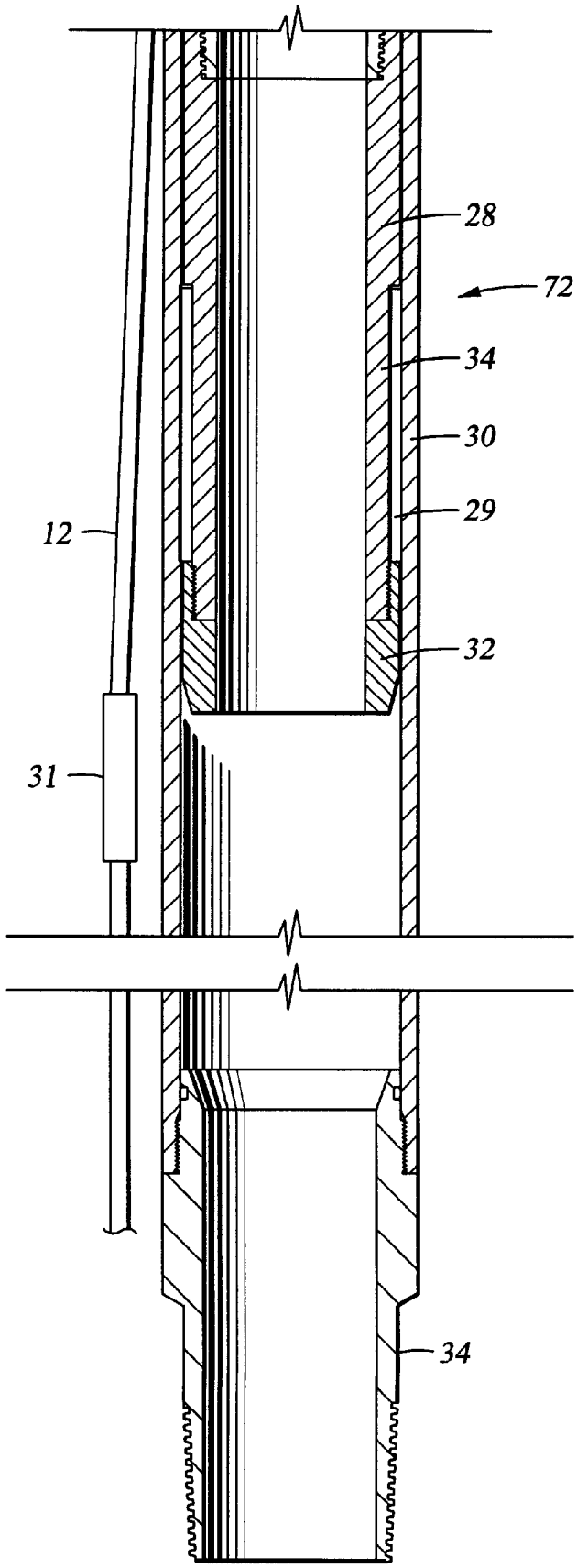
FIG. 1C is a cross sectional view of a tool of the invention showing the lower end of the tool, the connection of the polished bore section to the lowermost end which is threaded to attach to the latch assembly of the previously set BHA packer.

As depicted in FIG. 1C, control line or lines 12 may be continued downward from the lower side of the lockout block housing 17 to run to any additional downhole devices which may utilize hydraulics for their operation or control. In each control line below the well tool of the invention, a burst or rupture disc 31 can be provided to allow pressure to be held in the control lines while running the system into the hole. While a burst disk is shown in the Figures, it will be understood that any element providing an initially closed flow channel that can be subsequently opened could be utilized.

The telescoping tool of the present invention includes a means for imparting rotational movement to the tool from the ocean surface consisting of a dog clutch mechanism 27 provided on the lower end of the lockout block housing 17. The dog clutch mechanism is shown in detail in FIG. 4 and engages mating sections at the top end of the seal assembly on the lower end of tubular body member 13 that run inside the polished bore receptacle 30. Teeth 27*a* on the clutch mechanism 27 periphery engage mating teeth 27*b* on the exterior of a seal assembly 28.

FIG. 3 is a cross-sectional view of the telescoping tool of the present invention along line 3—3 of FIG. 1B illustrating the lockout block assembly. The lockout block 21 includes thread forms 68 on its inner surface 70 to mate with thread forms 13*a* on tubular body member 13. Lockout block 21 is disposed in lockout block housing 17 and is initially held in contact with body member 13 and secured thereto by shear pins 22. While the apparatus of the invention is being run into the hole, the tool is in an extended position with body member 13 extended in relation to lockout block 21. In the extended position the lockout block 21 is held in place by one or more of the shear pins 22. The rating or strength of the shear pins holding the lockout block in place is chosen such that the anchor seal assembly can be stabbed into the previously set packer in the BHA without causing the pins to fail. When the anchor seal assembly engages the packer or other device in the well (or releases from it) the shear pins remains intact and the tool remains fully extended. When shear pins 22 are broken due to the application of additional force, a pair of coil springs 23 urge lockout block 21 into contact with the body member 13 away from housing 17. The shear pins 22 are broken as the weight of the drill string is set down forcing the lockout block 21 away from the tubular body member 13 outward of the thread forms 13*a* on the tubular body member 13. The coil springs 23 enable the lockout block to ratchet the tubular body member 13 downward along the thread forms to land the tubing hanger in a wellhead. Once the body member has traveled down the well a desired distance, i.e., the tool is telescoped, the lock piston 18 can be moved downwardly into channel 19 until snap ring 24 engages the piston 18 holding lockout block 21 in its locked position in contact with tubular body member 13. FIG. 1C is a cross-sectional view of the lower end of a tool of the invention. A seal assembly 72 is provided on the lower end of the tubular body member 13. The seal assembly 72 comprises a seal mandrel 28 threadably connected to a seal retainer 32 on its lower end. Seals 29, such as v-packing or molded seals, are located between seal housing sleeve 28 and seal retainer 32 and form a fluid tight seal when moved along the polished bore receptacle 30. The polished bore receptacle 30 is provided on its lower end with a threaded section 34 on its exterior surface. Rotary motion of the tubing from the surface may be imparted to the entire tool assembly and threaded section 34 engages a matching threaded section on the upper end of the BHA packer mechanism (not shown) which is already in place, latching the tool assembly thereto. The control line 12 is provided near the lower end of the tool with a burst disc 31. Rupture of burst disc 31 allows hydraulic control fluid to flow to any tools located below the BHA packer assembly when the above described system is latched in place.

Figure 5:
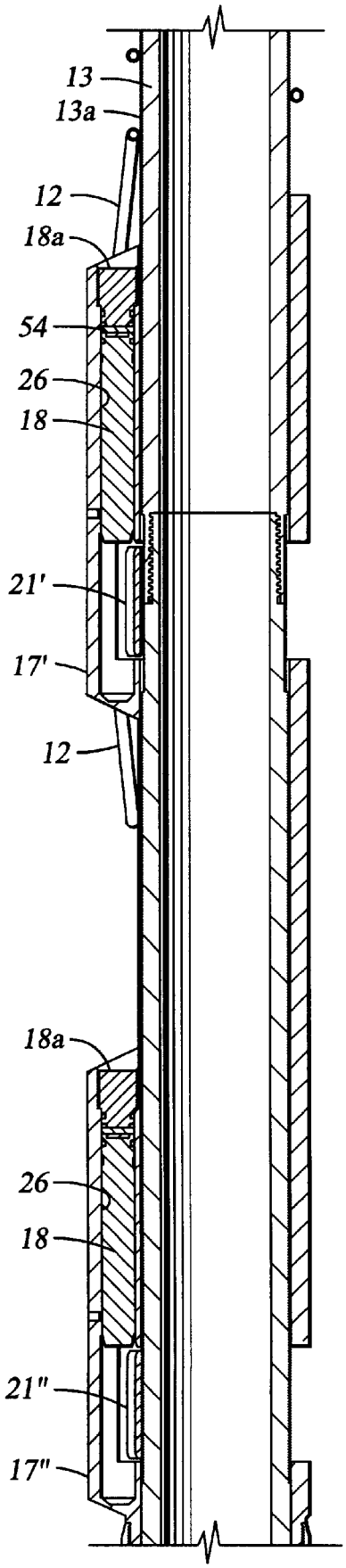
FIG. 5 is a cross-sectional view of a tool of the invention having two lockout block assemblies.

Alternative embodiments will be described below with reference to FIGS. 5–8. In these alternative embodiments, numbers are provided for common parts described above. FIG. 5 illustrates one alternative embodiment having a pair of (or two or more) lockout blocks 21' and 21" disposed in separate lockout block housings 17' and 17". Multiple lockout blocks enables the lockout assembly to be used in applications where two or more joints of tubing are connected and may have wrench flats along a portion of their length. Multiple lockout blocks insures that at least one of the lockout blocks 21' and 21" engage the tubular body member 13. The lockout blocks 21' and 21" are spaced a sufficient distance apart so as to prevent both lockout blocks from landing on a wrench flat e.g., an area at the connection of two pipes where there are no thread forms, which is engaged by wrenches when connecting two joints of pipe.

The lockout block assemblies are generally spaced apart by about one to two feet, though the spacing is dictated by the application.

Figure 6:
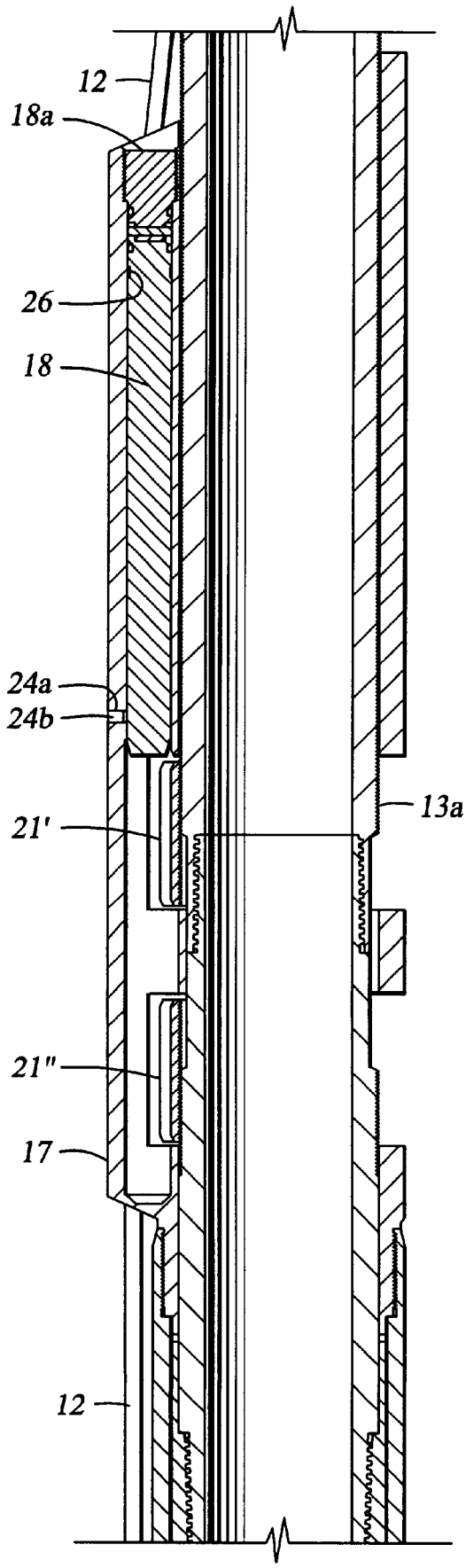
FIG. 6 is a cross-sectional view of a tool having a lockout block assembly having two lockout blocks.

FIG. 6 illustrates another alternative embodiment having a pair of lockout blocks 21' and 21" disposed in a single housing 17 and spaced a sufficient distance to ensure that at least one of the lockout blocks 21', 21" contacts the thread forms on the tubular body members. A single lockout member 18 can be actuated to lock the lockout blocks 21' and 21" in contact with tubular body member 13.

Figure 7:
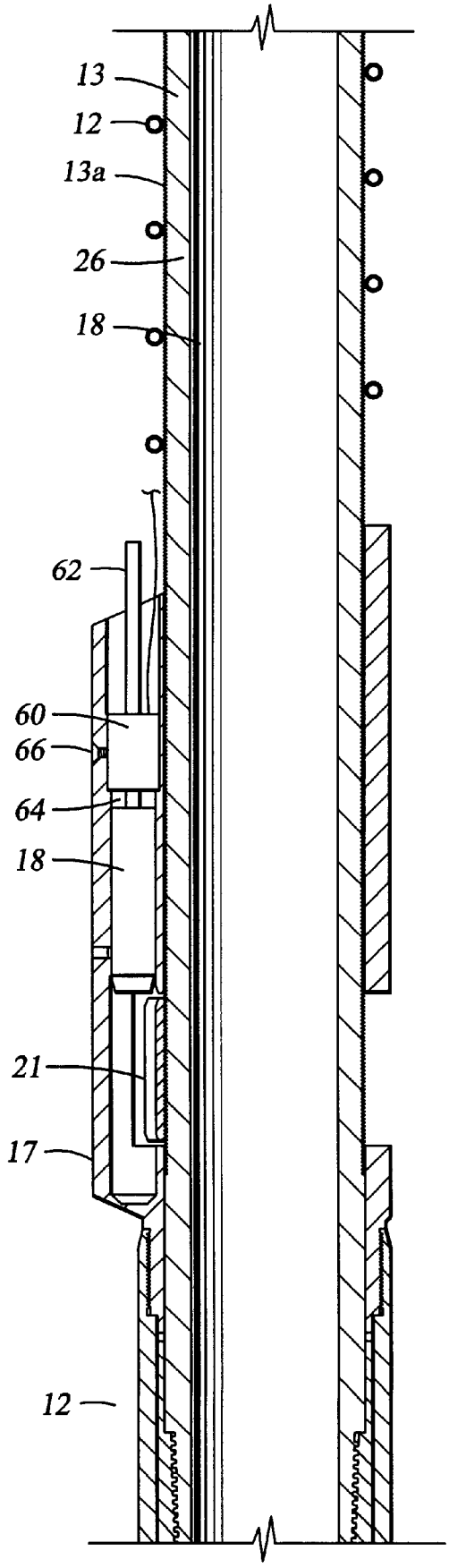
FIG. 7 is a cross-sectional view of a tool of the invention having an electric actuator to actuate the lock member.

In still another embodiment shown in FIG. 7, a solenoid 60 or other electric type actuator may be used to actuate piston 18 into a locked position once telescoping of the tool has been achieved. As shown in FIG. 7, a solenoid 60 is disposed adjacent the piston 18 and is connected to the surface by electric line 62. Once telescoping has been accomplished, the solenoid is activated via the electric line and a solenoid piston 64 is actuated downwardly to engage the lock piston 18 and move the lock piston 18 into a lowered lockout position. The solenoid could be secured in the housing 17 by a screw 66 or other connecting device or method.

Figure 8A:
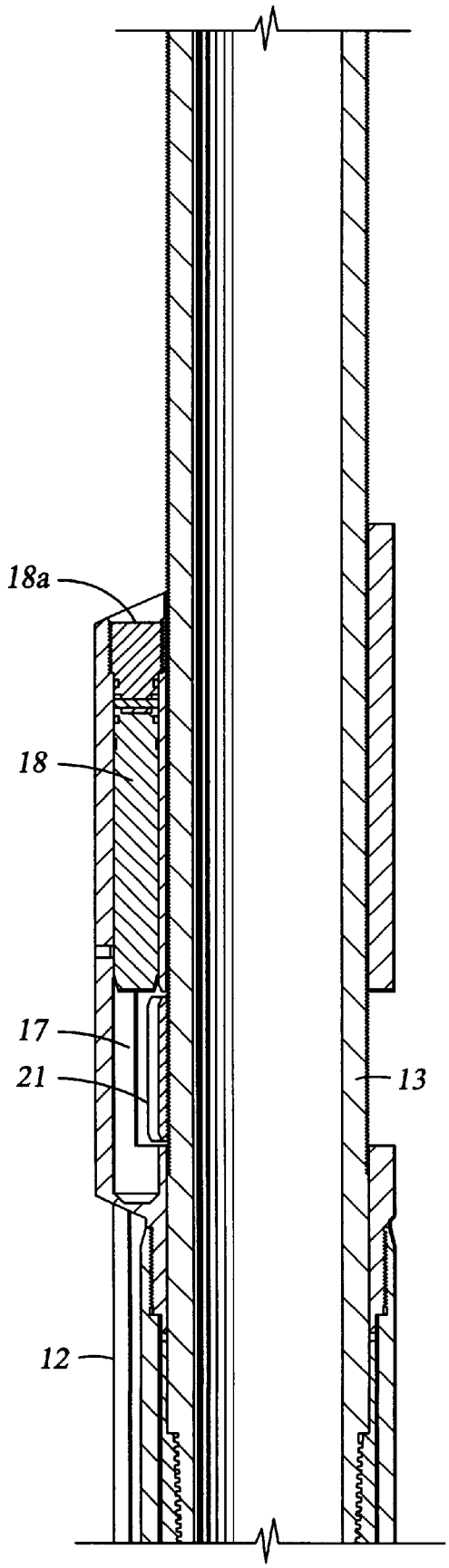
FIGS. 8A and 8B are cross-sectional views of a tool of the invention utilizing a source of fluid pressure within the tubular body member.
Figure 8B:
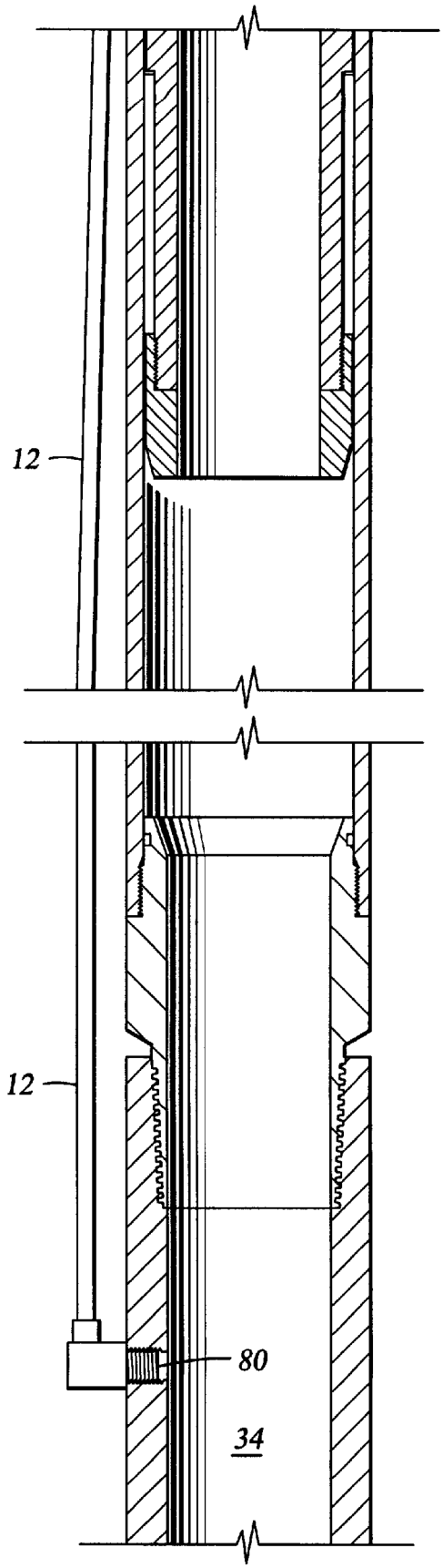

In another embodiment illustrated in FIGS. 8A and 8B, the source of hydraulic control fluid to actuate piston 18 is provided within the tubular body member 13 rather than through an external control line from the drilling platform. FIGS. 8A and 8B are section views showing an aperture 80 formed in the wall of a ported "sub" connected to the lower end of threaded section 34. In this embodiment, control line 12 extends from the aperture 80 to the lower end of lockout block housing 17 (FIG. 8A), where it is internally ported to the top of piston 18. Preferably, the flow bore of the tubular member 13 is blocked by a plug located somewhere below aperture 80. For example, a plug could be either in a downhole packer or in the bottom of the tubing string and removable with a wire line or coiled tubing.

In operation, the tool is run into the well bore in its fully extended position as shown in the drawings. At the lowermost end of the workover completion tubular tool of the present invention, there is an anchor seal assembly. This assembly sealingly engages and locks into a mating receptacle in the previously set packer in the BHA. This anchor seal assembly can either be a single string anchor, or can be a more complicated downhole latching device having multiple seal devices for reconnection at the top of a BHA packer. In a run-in position, the lock piston is shear pinned to its retainer cap so that it cannot be accidentally activated, with pressure being maintained in the control lines. Upon engagement with the BHA packer, set down weight is applied to the lockout block assembly causing shear pins 22 to be broken. The body member 13 is moved downward in the polished bore receptacle until the liner hanger is properly positioned in the wellbore. Pressure in control line 12 is then increased to move lock piston 18 downwardly in the lockout housing 17 and into the channel 19 to urge the lockout block 21 toward its locked position. Upward pull can be used to test the latch. At this point, the entire tool assembly may be treated as a fixed length of tubing for the purpose of any further workover or completion work. Finally, further pressure increase in control line 12 bursts rupture disc 31 and establishes control line 12 fluid communication with any other systems located below the BHA packer assembly.

The completion string is run into the borehole in the spaced-out position so that the anchor seal assembly engages the mating receptacle(s) of the previously set downhole packer sequentially ahead of the tubing hanger landing in the previously installed subsea wellhead. The control lines are stored on reels on the surface vessel and are connected or made up to the upper side of the control line manifold block at the upper end of the apparatus of the invention. While running the tool string of the invention into the borehole, pressure is held in the control line to ensure that there are no leaks at any of the connectors. The pressure held in is kept lower than that required to shear the shear pin which retains the lock piston in position. The rupture disc run in on the tubing string below the apparatus of the invention also has a burst pressure rating much greater than the shear pin rating of the pin holding the lock piston.

When the tool string is run into the borehole, the anchor seal assembly lands on the previously installed packer in the BHA and engages in the mating receptacle(s), but because of the tool string being in the space-out configuration the tubing hanger does not contact the well head apparatus. Even though the seal assembly is stabbed into the packer mating receptacle, the apparatus of the invention will not yet deploy as the force required to stab-in the tool assembly is less than the load required to shear the shear pins and release the telescoping apparatus. Depending on the type of mating receptacle anchor assembly and the operational requirements of a particular well, the anchor seal assembly can be released from the packer after stab-in. A straight upward pull can be used in the case of a snap latch type device or rotational motion can be used if the tool string hookup is concentric.

In cases where it is not desired to release the anchor seal assembly from the BHA packer, the application of set down weight will cause the shear mechanism, e.g., the shear pins 22, to release and the seal assembly to ratchet down past the lockout block housing and into the polished bore receptacle. Once the tubing hanger fully engages the subsea well head, there is no further downward movement of the entire tubing string and tool string below the hanger. However, it is possible to pull the tubing hanger out of the subsea well head by placing some upstrain pull on the tubing. The tubing string seal anchor engagement may thus be checked by applying only enough upstrain pull to lift the weight of the tubing/tool string plus less than that required to disengage the anchor seal assembly from the BHA packer.

At this point while holding set down weight on the tubing the pressure in the control line to the lock piston port may be increased. This pressure increase acts directly on the top end of the lock piston and, when it reaches an appropriate value, causes release of the shear pin retaining the lock piston to release from the seal retainer cap. This causes the lock piston to move downwardly forcing the lockout block to be locked in place in threaded engagement with the tubing string. At the end of the lock piston stroke, a snap ring is provided to snap into a mating groove in the lock piston, effectively trapping the piston in its locked or fully extended position. Further increase in control line hydraulic pressure causes the bursting of the in-line rupture discs and allowing fluid communication to any downhole devices below the BHA or the tool apparatus of the invention. Pressure and/or temperature changes will not affect the locked tool and any future retrieval of the completion/workover tool may be accomplished by simply retrieving the locked tool string as a fixed length of tubing.

While, as previously stated, multiple latches for separate tubing strings may be employed on the BHA packer, the embodiment shown is for a concentrically arranged latch which mates to the lowermost end of the tool of the invention by threaded engagement imparted by rotational motion of the tool/tubing after stabbing in is accomplished.

However, the invention is contemplated for use with more complex latches employing plural separate tubing strings and latches in the BHA packer assembly as well While foregoing is directed to the preferred embodiment of the present invention, other and further embodiments of the invention may be devised without departing from the basic scope thereof, and the scope thereof is determined by the claims that follow.

What is claimed is:

1. A well tool for axially adjusting a tubular string in a well bore comprising:

a first body fixable at a lower end in the well, the first body comprising a tubular, a housing disposed above the tubular, and a lock block at least partially disposed in the housing;

a second body comprising a tubular, the second body selectively fixed at a first location relative to the first body, wherein a portion of the second body is fixed within the first body by at least one shearable member extending between the lock block and the second body and by at least one biasing member disposed between the lock block and the housing; whereby upon a first condition, the second body is axially movable to a second position relative to the first body.

2. The tool of claim 1, wherein the lower end of the tool includes an anchor seal assembly.

3. The tool of claim 1, wherein the lower end of the tool includes a device selectively fixable within the well at a predetermined location.

4. The tool of claim 1, wherein the first body further comprises a lock member disposed in the housing.

5. The tool of claim 1, wherein the first condition includes application of a first axial force upon the second body sufficient to break the shearable member.

6. The tool of claim 5 wherein the first condition further includes application of a second force upon the second body after the shearable member is broken sufficient to cause the second body to move to the second position.

7. The tool of claim 6, wherein movement of the second body to the second position is accomplished by the interaction of inwardly facing thread forms on the lock block and outwardly facing thread forms on the second body, the outwardly and inwardly facing thread forms allowing a downward motion of the second body with respect to the first body member.

8. The tool of claim 7, wherein the tool further includes a piston assembly constructed and arranged to lock the lock block into engagement with the second body in the second position upon a second condition.

9. The tool of claim 8, wherein the second condition includes a force sufficient to cause the piston to move from a retracted position to an extended position in contact with the lock block.

10. The tool of claim 1, wherein movement of the second body to the second position is accomplished by the interaction of inwardly facing thread forms on the lock block and outwardly facing thread forms on the second body, the outwardly and inwardly facing thread forms allowing a downward motion of the second body with respect to the first body member.

11. The well tool of claim 1, further comprising a clutch mechanism disposed on one end of the lockout block housing.

12. A well tool for axially adjusting a tubular string in a wellbore, comprising:

a first body member comprising a tubular;

a second body member comprising a tubular and having on its upper end a control line manifold block adapted to receive on its upper side a control line and on its lower side a section of control line wound about the second body member;

a lockout block housing attached to the first body member and having an internal chamber, wherein the second body member is at least partially disposed in the first body member and the lockout block housing;

a lockout block disposed in the lockout block housing and movably attached to the second body member; and a lock member slidably disposed within the lockout block housing.

13. The well tool of claim 12 further comprising a clutch mechanism disposed on one end of the lockout block housing.

14. The well tool of claim 12 wherein the body member comprises thread forms formed on an outer surface thereof and the lockout block comprises mating thread forms formed on an inner surface thereof.

15. The well tool of claim 12 wherein the control line comprises at least one fluid control line and the lockout block housing is in fluid communication with at least one fluid control line.

16. The well tool of claim 12 further comprising an electric actuator to move the lock member into at least a locked position.

17. The well tool of claim 12 wherein the lockout block housing and the lockout block at least partially define a bore in which the lock member is received in a locked position.

18. The well tool of claim 17 wherein the lockout block is retained in the lockout block housing by one or more springs.

19. The well tool of claim 18 wherein the lockout block is initially retained by at least one lockout block shear pin.

20. The well tool of claim 19 wherein the lock member is initially retained by a lock cap and a lock member shear pin.

21. The well tool of claim 12 further comprising:

a second lockout block housing attached to the body member and having an internal bore;

a second lockout block disposed in the second lockout block housing; and a second lock member slidably disposed within the second lockout block housing.

22. The well tool of claim 12 further comprising a second lockout block disposed in the lockout block housing.

23. The well tool of claim 12 further comprising one or more electric actuators connected to each lock member to provide actuation to each lock member.

24. A lock assembly for use on a well tool, comprising:

a lockout block housing, the lockout block comprising a bore and a chamber in fluid communication with the bore;

a lockout block movably and at least partially disposed in the lockout block housing;

a lockout member movably disposed in the chamber, wherein the lockout member is sized and adapted to be at least partially received between the lockout block housing and the lockout block; and one or more springs disposed adjacent the lockout block to urge the lockout block into engagement with a tubing member.

25. The lock assembly of claim 24 wherein the lockout block housing is in fluid communication with at least one fluid control line and the lockout member is movable on fluid pressure provided through the at least one control line to the lockout block housing.

26. The lock assembly of claim 25 further comprising a solenoid connected to the lockout member to provide actuation thereto.

27. The lock assembly of claim 26 wherein the lockout block is initially retained in the lockout block housing by one or more shear pins.

28. The lock assembly of claim 27 farther comprising:

a second lockout block housing partially defining a bore therein;

a second lockout block movably disposed in the lockout block housing and partially defining a bore therein; and a second lockout member movably disposed in the lockout block housing sized and adapted to be received in the bore formed at least partially in the lockout block housing and the lockout block.

29. The lock assembly of claim 24 further comprising a second lockout block movably disposed in the lockout block housing.

30. A method for axially adjusting a tubular string in a wellbore, comprising the steps of:

running into the wellbore a tubing string having an extended telescoping well tool, the extended telescoping well tool comprising:

a first tubular;

a second tubular movably connected to the first tubular; and a lock assembly connected to the first tubular, the lock assembly includes a lock housing, a lockblock member at least partially disposed in the housing, and a lock member disposed in the housing;

applying set down weight to shear at least one pin at least partially disposed in the lockblock member to cause the extended telescoping well tool to retract;

applying hydraulic pressure to a hydraulic control line to cause the lock member to move into a position between the lockblock member and the housing to lock the well tool in the retracted position.

31. A well tool for axially adjusting a tubular string in a well bore comprising:

a first body fixable at a lower end in the well, the first body comprising a lock block and a housing;

an second body selectively fixed at a first location relative to the first body; wherein the second body is fixed within the first body by at least one shearable member extending between the lock block and the second body and by at least one spring mounted between the lock block and the first body and biasing the lock block into engagement with the second body; whereby upon a first condition, the second body is axially movable to a second position relative to the first body, wherein the first condition includes application of a first axial force upon the second body sufficient to break the shearable member and application of a second force upon the second body after the shearable member is broken sufficient to cause the second body to move to the second position, wherein movement of the second body to the second position is accomplished by the interaction of inwardly facing thread forms on the lock block and outwardly facing thread forms on the second body, the outwardly and inwardly facing thread forms allowing a downward motion of the second body with respect to the first body.

32. The tool of claim 31, wherein the tool further includes a piston assembly constructed and arranged to lock the lock block into engagement with the second body in the second position upon a second condition.

33. The tool of claim 32, wherein the second condition includes a force sufficient to cause the piston to move from a retracted position to an extended position in contact with the lock block.

34. A well tool for axially adjusting a tubular string in a wellbore, comprising:

a body member having on its upper end a control line manifold block adapted to receive on its upper side a control line and on its lower side a section of control line wound about the body member;

a lockout block housing attached to the body member and having an internal chamber;

a lockout block disposed in the lockout block housing;

a lock member slidably disposed within the lockout block housing; and a clutch mechanism disposed on one end of the lockout block housing.

35. A well tool for axially adjusting a tubular string in a wellbore, comprising:

a body member having on its upper end a control line manifold block adapted to receive on its upper side a control line and on its lower side a section of control line wound about the body member;

a lockout block housing attached to the body member and having an internal chamber;

a lockout block disposed in the lockout block housing;

a lock member slidably disposed within the lockout block housing; and a second lockout block disposed in the lockout block housing.

* * * * *

UNITED STATES PATENT AND TRADEMARK OFFICE

CERTIFICATE OF CORRECTION

PATENT NO. : 6,349,770 B1 
DATED : February 26, 2002
INVENTOR(S) : Robert T. Brooks and John Whitsitt It is certified that error appears in the above-identified patent and that said Letters Patent is hereby corrected as shown below:

Column 9,
Line 9, replace “farther” with -- further --;
Line 46, replace “an second body” with -- a second body --.

Signed and Sealed this

Twenty-seventh Day of July, 2004

JON W. DUDAS
*Acting Director of the United States Patent and Trademark Office*